United States Patent [19]

Ring et al.

[11] Patent Number: 4,775,133

[45] Date of Patent: Oct. 4, 1988

[54] ELECTRIC AIR VALVE

[75] Inventors: H. Kenneth Ring, Houston, Minn.; Dennis L. Manthei, West Salem; Steven C. Weber, La Crosse, both of Wis.

[73] Assignee: American Standard Inc., New York, N.Y.

[21] Appl. No.: 109,653

[22] Filed: Oct. 19, 1987

[51] Int. Cl.[4] ..... F16K 31/04

[52] U.S. Cl. ..... 251/129.12; 137/219; 137/554; 251/129.11

[58] Field of Search ..... 251/129.12, 129.11; 137/219, 554

[56] References Cited

U.S. PATENT DOCUMENTS

| | | | |
|---|---|---|---|
| 1,974,335 | 9/1934 | Kimball | 251/129.12 |
| 2,598,062 | 5/1952 | Krecan | 251/129.12 |
| 2,821,343 | 1/1958 | Payne | 236/13 |
| 3,071,149 | 1/1963 | Rhodes | 251/129.12 X |
| 3,616,884 | 11/1971 | Balz | 251/129.12 X |
| 3,974,859 | 8/1976 | McNabney | 137/625 |
| 4,082,114 | 4/1978 | Hantke et al. | 137/625 |
| 4,177,970 | 11/1979 | Ring, Jr. | 251/61 |
| 4,305,418 | 12/1981 | Jensen et al. | 137/219 |
| 4,500,036 | 2/1985 | Vollmer | 251/129.12 X |

*Primary Examiner*—Arnold Rosenthal

*Attorney, Agent, or Firm*—William J. Beres; David L. Polsley; Robert J. Harter

[57] ABSTRACT

An air valve actuated by an electric motor has a cylindrical inlet section. The inlet section defines a seating surface upstream of which is a support grid. A backplate to which the actuating motor is mounted is supported by a plurality of rods that extend downstream of the inlet section. A damper assembly includes a generally planar damper mounted for movement axial of the inlet section. The damper assembly includes a splined rod which extends upstream of the damper and into a cooperating spline in the support grid. A threaded spindle extends downstream of the damper plate through a cooperatively threaded motor-driven drive gear which is mounted for rotation on the backplate. Because a portion of the damper assembly is splined, the damper assembly cannot rotate and is driven axially within the valve by the rotation of the drive motor and drive gear. The backplate is spring biased so that upon the abutment of the damper plate with the inlet section seating surface the backplate becomes spring loaded in a manner which minimizes the chance that the drive motor will stall.

25 Claims, 4 Drawing Sheets

ELECTRIC AIR VALVE

BACKGROUND OF THE INVENTION

The present invention relates generally to inventions which are the subject matter of concurrently filed patent applications entitled "Normally Closed Pneumatic Air Valve" and "Normally Open Pneumatic Air Valve", U.S. Ser. Nos. 109,892 and 109,657 respectively, both of which are assigned to the assignee of the present invention.

The present invention relates to an electrically actuated air valve for use in an air distribution system wherein the volume of conditioned air supplied to a zone is varied in order to control the temperature within the zone.

One of the most common types of building ventilation systems is the variable air volume system wherein a central source provides conditioned air for distribution to various zones within a building via a network of ducts. Since heating and cooling requirements vary from zone to zone, and within individual zones depending upon factors such as solar load and zone usage, it is necessary that provision be made to selectively control the amount of conditioned air supplied to a particular zone in response to local demand.

In a variable air volume system, the selective delivery of conditioned air to a particular zone is accomplished through the association of at least one air distribution box with each zone. Such air distribution boxes define supply plenums and include one or more air outlets in communication with the zone. Additionally, each box has an airflow control valve, for varying the volume of air delivered into the plenum. Such air valves are controlled by a thermostat in the zone so as to supply the proper volume of conditioned air to maintain or achieve a selected zone temperature.

The present invention is directed to an electric motor driven air valve for use in variable air volume air distribution systems. Th most common type of electrically driven air valve is that shown and taught in U.S. Pat. No. 4,082,114, to Hantke et al., which is assigned to the assignee of the present invention. The valve of the Hantke patent includes a closed ended cylindrical portion downstream of the valve inlet in which a generally tubular valve member is disposed for movement axially of the valve housing. The size of a series of radial ports, and therefore the flow of air through the valve, is determined by the position of the valve member within the cylindrical, closed ended valve housing. The valve of the Hantke design is relatively complex and is, as well, somewhat expensive of manufacture. Additionally, dedicated sealing means are required at each peripheral edge of the tubular valve member in order to completely shutoff airflow through the valve.

The need continues to exist for an electric motor driven air valve which is relatively uncomplicated and inexpensive of manufacture yet which provides for the precise control of the volume of air flowing through the valve and which is not susceptible to motor stalling.

The present invention is directed generally to an electric air valve having a novel actuator structure, which is commercially practical and which is not susceptible to motor stalling.

SUMMARY OF THE INVENTION

It is an object of the present invention to provide an air valve assembly which includes novel yet simple actuator means integral with the valve so as to eliminate the need for separately mounting the actuator portion of the valve.

It is another object of the present invention to provide an electric motor driven air valve assembly wherein the valve actuating mechanism is disposed downstream of both the valve inlet and valve damper plate for achieving the quiet, controlled flow of air through the valve.

It is another object of the present invention to provide an electrical air valve having a die cast inlet section which defines a venturi-like passage so as to reduce system static pressure requirements.

It is another object of the present invention to provide a motor driven air valve which employs no levers, blades or linkages.

It is still another object of the present invention to provide a motor driven air valve having an inlet section which is configured for mounting to an air distribution box in a manner which supports the entire structure and weight of the valve and which allows for the efficient mounting of the valve to the box and the removal of the valve therefrom.

It is a further object of the present invention to provide an electric motor driven air valve which is not susceptible to motor stalling.

These and other obejcts of the present invention, which will become apparent when the following Description of the Preferred Embodiment and attached drawing figures are simultaneously considered, are accomplished by an electric motor driven air valve having a unitary inlet section which defines a seating surface and has a spider-like support grid in its upstream portion. A backplate is disposed downstream of and is supported by the inlet section. For purposes of this patent, upstream will refer to the direction from which air is supplied to the valve while downstream will refer to the direction of airflow through the valve as is indicated by the arrows in the drawing figures.

The electric motor driven air valve of the present invention includes a unitary damper assembly which is comprised of a generally flat damper plate having a formed peripheral seating surface. The damper assembly has a splined shaft extending upstream of the damper plate and a threaded spindle extending downstream from the damper plate. The damper assembly is mounted between the backplate and the inlet section of the valve.

The splined shaft extending upstream of the damper plate is slideably engaged in a cooperating splined bushing disposed in the inlet section support grid. The threaded spindle extending downstream of the damper plate is supported in a cooperatively threaded drive gear mounted for rotation on the backplate.

An electric motor is mounted on the backplate which drives the rotatably mounted drive gear through a pinion. Because the damper assembly is splined on its upstream end and is thereby prevented from rotating and because the threaded downstream extending spindle is threadably engaged in the rotatably mounted drive gear, the rotation of the drive gear causes the damper assembly to be driven axially of the valve inlet section in accordance with the direction of motor rotation. The motor is a reversible motor.

The motor drives the damper assembly into contact with the inlet section seating surface so as to close off airflow through the valve. The backplate is mounted so that subsequent to the abutment of the damper assembly with the inlet section seating surface the backplate is caused to be physically moved downstream against biasing springs. The spring loading of the backplate is in a direction which mechanically assists the drive motor in overcoming the forces which oppose the opening of the valve thereby minimizing the likelihood of motor stalling.

Power to the drive motor is interrupted at the end of both the opening and closing strokes of the damper plate by the contact of the damper plate with limit switches affixed at predetermined locations on the valve. The positioning of the limit switches and the spring mounting of the backplate ensure that the motor, which is typically a small fractional horsepower motor, is not stalled at either end of the damper stroke.

DESCRIPTION OF THE PREFERRED EMBODIMENT

Figure 1:
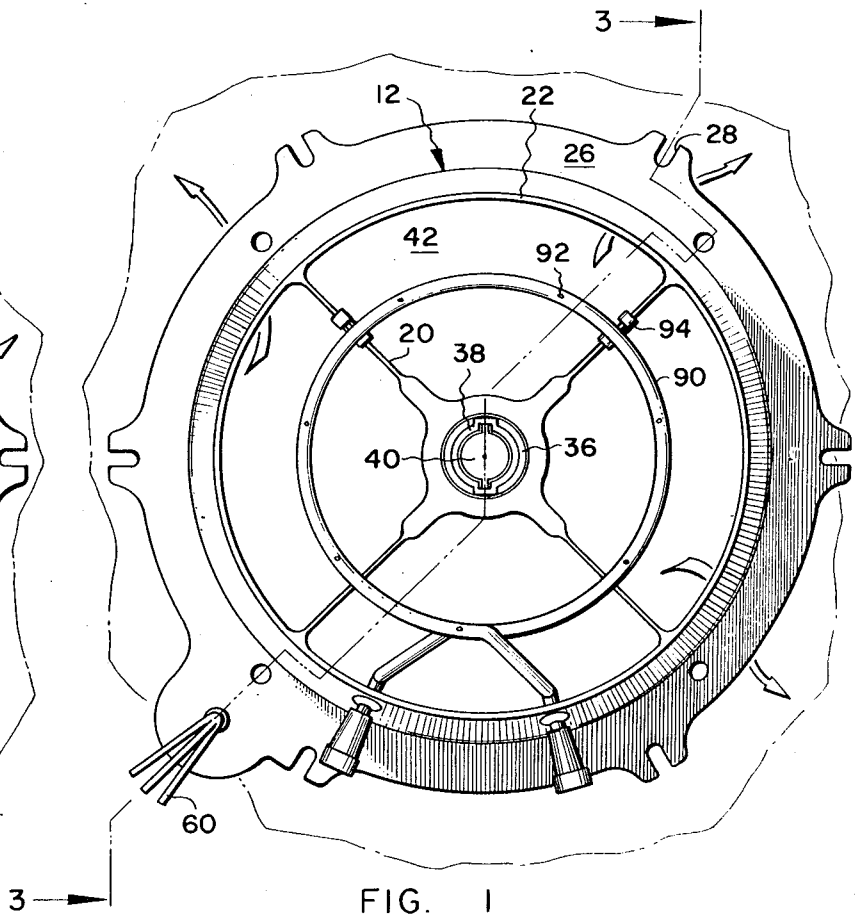
FIG. 1 is an end view of the air valve of the present invention when viewed from upstream of the valve.

Referring primarily to FIGS. 1 through 4, air valve 10 is comprised of three primary sections, die cast inlet section 12, backplate 14 and damper assembly 16. Backplate 14 is attached to and supported by inlet section 12 through a plurality of rods 18 which extend downstream of the inlet section. The air passage defined by die cast inlet section 12 is venturi-like in nature and provides for relatively low static pressure requirements in the system in which valve 10 is employed. Damper assembly 16, as will further be discussed, is supported for slideable movement axial of the longitudinal axis of inlet portion 12 by both backplate 14 and a spider-like support grid 20 in inlet section 12.

Figure 3:
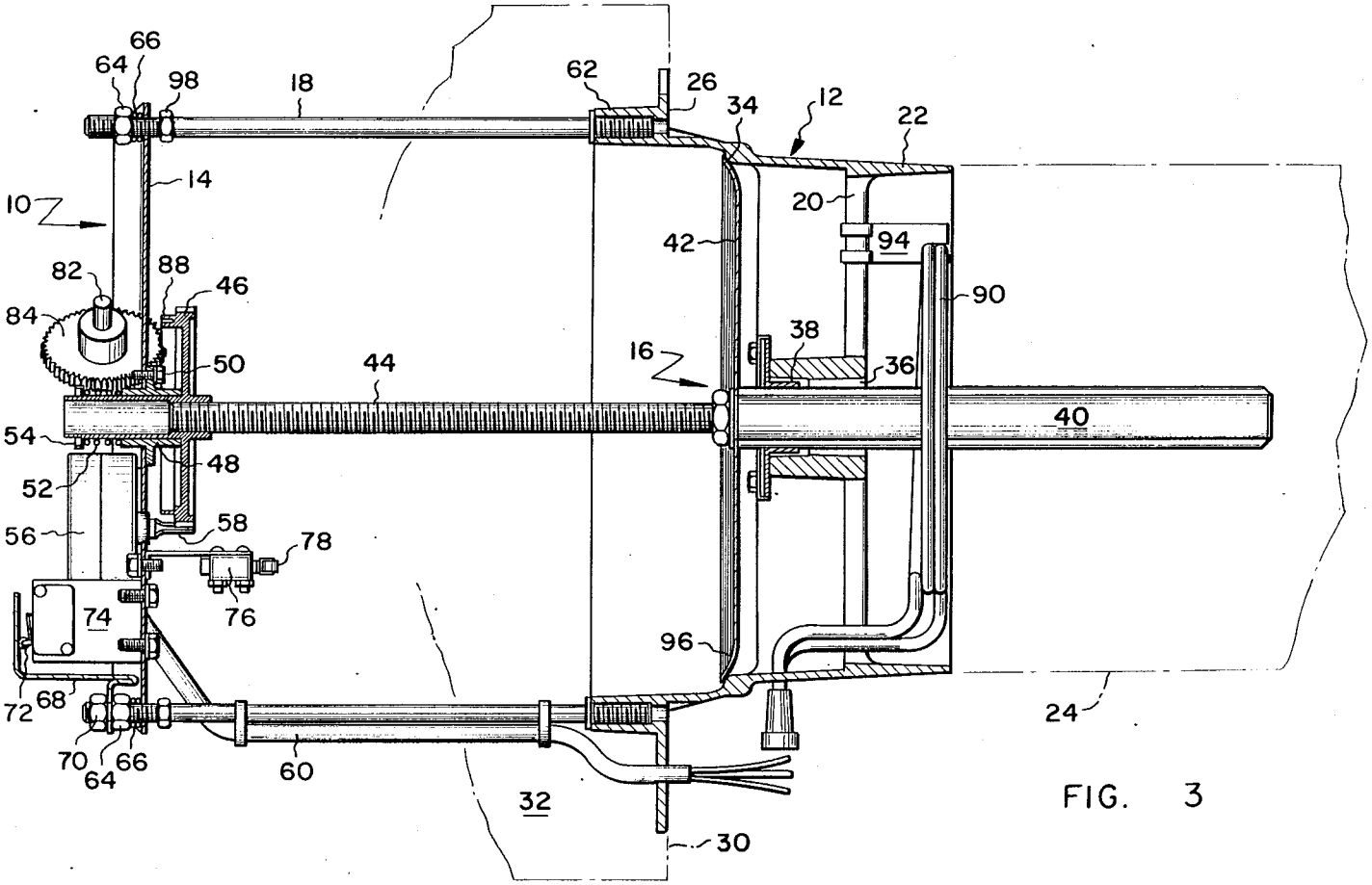
FIG. 3 is a cross-sectional view taken along lines 3—3 of FIG. 1 illustrating the air valve of the present invention in the fully closed position.
Figure 4:
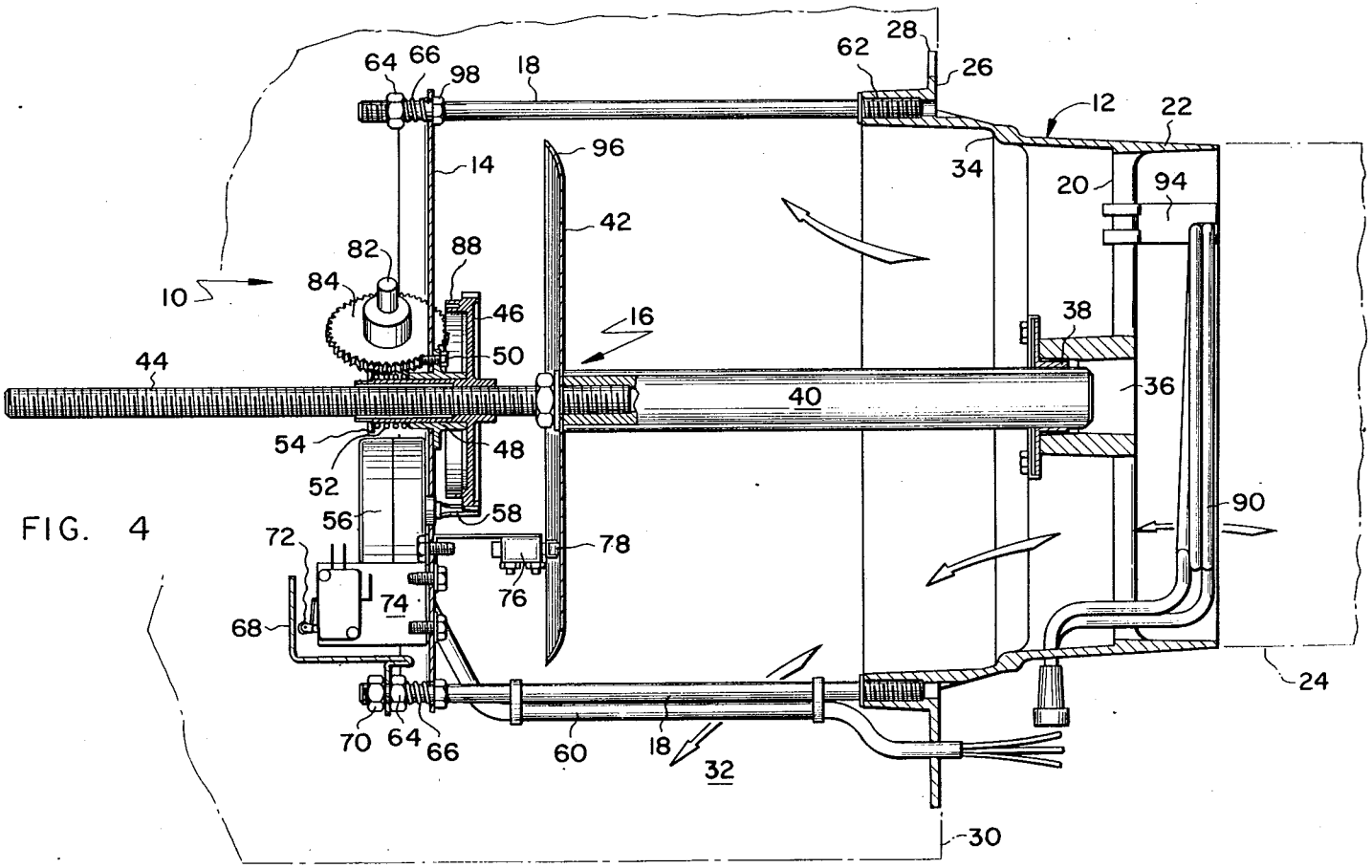
FIG. 4 is a cross-sectional view taken along lines 3—3 of FIG. 1 illustrating the valve of the present invention in the fully open position.

Inlet section 12 of valve 10 has a surface 22 which is configured for engagement with a building air supply duct 24, illustrated in phantom in FIGS. 3 and 4. Inlet section 12 also has a radially extending flange 26 from which a series of lugs 28 extend so as to permit the attachment and mounting of valve 10, by means of sheet metal screws (not shown), to an air distribution box 30. The air distribution box, shown in phantom in FIGS. 3 and 4, defines a plenum 32 the flow of air into which is controlled in accordance with the position of damper assembly 16 of the air valve 10.

Inlet section 12 of valve 10 defines a generally annular seating surface 34 in its interior and includes the aforementioned support grid 20 which defines an aperture 36 in which a splined bushing 38 is retained.

A cooperatively splined shaft 40 is captured for slideable movement through bushing 38. By virtue of the spline fit of shaft 40 in bushing 38, the rotation of splined shaft 40 is prevented. Splined shaft 40 is fixedly attached to and extends upstream of generally planar damper plate 42 which has a formed peripheral seating surface 96. Fixedly attached to and extending downstream from damper plate 42 is a threaded spindle 44. Splined shaft 40, damper plate 42 and threaded spindle 44 comprise an essentially unitary damper assembly which, because of its splined portion, is prevented from rotating about its axis. Threaded spindle 44 of the damper assembly penetrates and is threadably engaged in drive gear 46.

Figure 5:
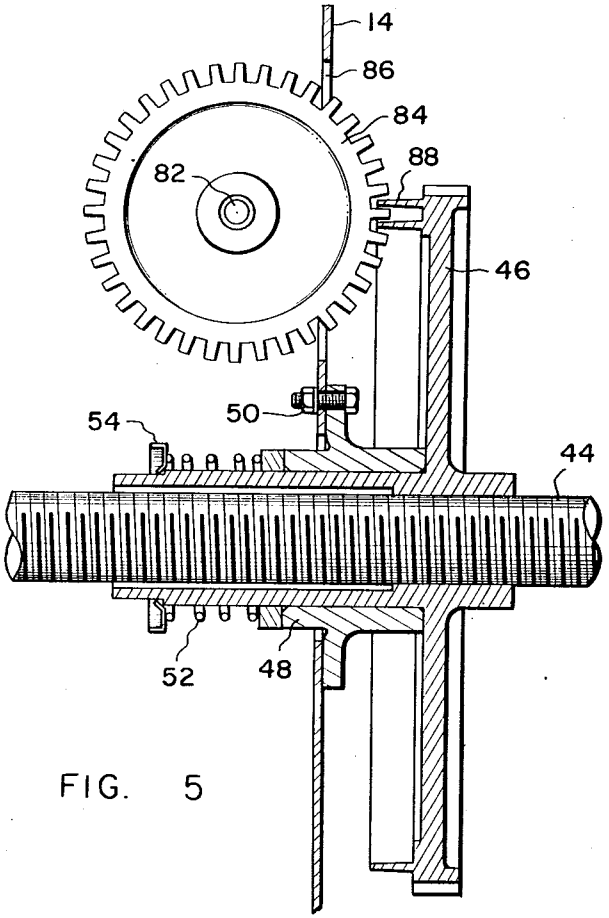
FIG. 5 is an enlarged cross-sectional view of a portion of the backplate and drive gear of the air valve of the present invention.

Referring additionally now to FIG. 5, it will be seen that drive gear 46 is mounted for rotation in a bushing 48 on backplate 14 of valve 10. Bushing 48 is fixedly attached to backplate 14 by screws 50. A spring 52 is trapped between a seating surface on bushing 48 and a spring clip 54. Spring clip 54 is attached to an extension of drive gear 46 which passes through and out of bushing 48 downstream of backplate 14. Spring 52 acts through clip 54 and drive gear 46 on threaded spindle 44 of the damper assembly to slightly pre-load/pre-tension the drive gear and damper assembly. The pre-tensioning of the drive gear and damper assembly prevents noise which might otherwise be associated with the chattering of the drive gear and damper assembly if it were not loaded.

Also attached to backplate 14 is an electric drive motor 56 which has a pinion 58 machined into or attached to its drive shaft. Pinion 58 meshingly engages the teeth of drive gear 46 such that the drive gear is caused to rotate in accordance with the direction of rotation of pinion 58. The direction of rotation of pinion 58 is determined by the direction of rotation of the drive shaft of drive motor 56 which is a reversible motor. Power is supplied to motor 56 through a leads 60.

Support rods 18, which extend downstream of inlet section 12, are threaded at both of their ends. The upstream end of each support rod 18 is threaded into a cooperatively threaded hole 62 in inlet section 12 while the downstream threaded end of the support rods penetrate cooperatively spaced holes in backplate 14.

Disposed between backplate 14 and nuts 64 which are fixedly threaded onto rods 18, are springs 66. Additionally, a formed metal clip 68 is fixedly mounted to the end of one of the rods 18 as by the trapping of a portion of the clip between a nut 64 and a locking nut 70. As will further be described, clip 68 is mounted for interaction with a detent 72 of limit switch 74. Limit switch 74 is fixedly attached to backplate 14 of the air valve 10. A backing nut 98 is also found on each rod 18. Backing nuts 98 are preferably integrally formed on tie rods 18, as by cold forming, so as to ensure the uniformity of their location on the tie rods.

A second limit switch 76 is fixedly mounted to backplate 14 of the air valve but in a manner such that its detent 78 interacts with damper plate 42.

Figure 2:
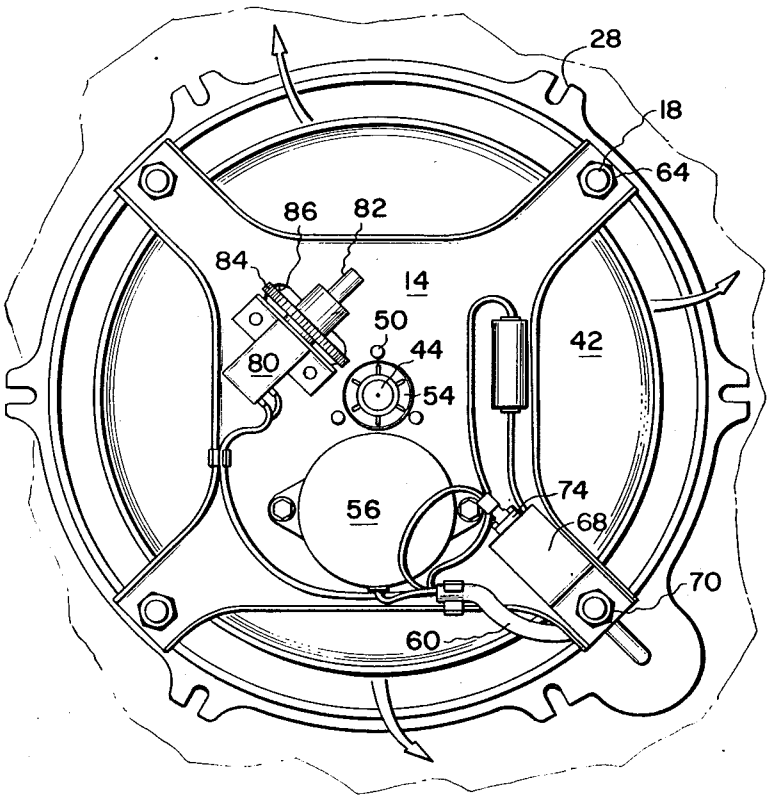
FIG. 2 is an end view of the air valve of the present invention from downstream of the valve.
Figure 6:
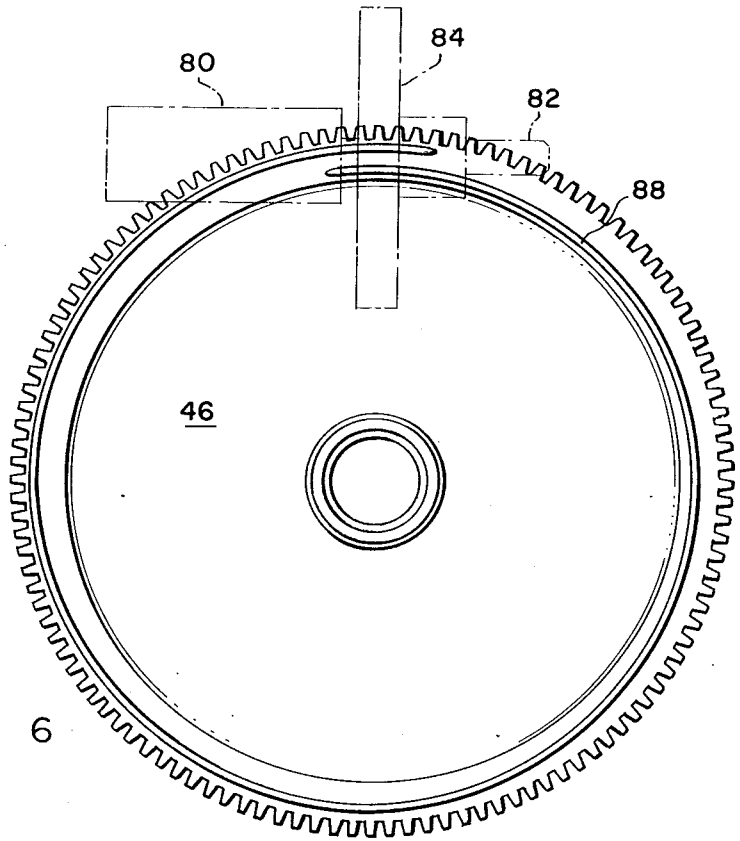
FIG. 6 is a view of the downstream face of the drive gear.

Valve 10 is additionally provided with apparatus for providing an indication of the position of damper plate 42. That apparatus includes a potentiometer 80 having a spindle 82 on which a gear 84 is mounted. Referring to FIGS. 2, 5 and 6 it will be seen that gear 84 protrudes through a slot 86 in backplate 14 and engages a spiral portion 88 that extends downstream of drive gear 46.

A flow sensing ring 90 is disposed in inlet section 12 and includes a series of apertures by which a static pressure is developed that indicates the volume of air flowing through valve 10. Flow sensor 90 is retained in place in inlet section 12 by a series of clips 94 which attach to support grid 20 found therein.

OPERATION

The position of damper plate 42 of damper assembly 16 of valve 10 is determinitive of the volume of air that flows into plenum 32 of the air distribution box 30. It will be appreciated that the volume of air flowing into plenum 32 is controllably varied by the selective positioning of damper plate 42 with respect to the seating surface 34 of inlet section 12. As the demand for conditioned air in the space with which plenum 32 communicates decreases, motor 56 is controllably energized so as to drive pinion 58 in a direction which ultimately causes damper 42 to move toward seating surface 34 of inlet section 12.

It will be appreciated that when pinion 58 rotates in a first direction, drive gear 46 is caused to rotate, within bushing 48, in the opposite direction. The rotation of drive gear 46 in turn causes threaded spindle 44 to advance or retreat axially of the inlet section depending upon the direction of the threading of spindle 44 and its cooperating threaded portion in gear 46. It will be remembered that splined shaft 40 is captured in splined bushing 38 so that damper assembly 16 is incapable of rotating.

If the demand for conditioned air decreases sufficiently, motor 56 drives damper plate 42 toward the seating surface of inlet section 12 to the extent that formed seating surface 96 of the damper plate is urged into abutment with seating surface 34 of inlet section 12. Motor 56 continues to run subsequent to the contact of damper plate 42 with seating surface 34.

In reaction to the prevention of damper plate 42 from continuing its upstream advance, due to its abutment with seating surface 34, backplate 14 is driven away from inlet section 12 immediately subsequent to the abutment of damper plate 42 and seating surface 34. That is, the reaction to the operation of motor 56 upon the abutment of the damper plate and inlet section seating surface switches from one which urges damper plate 42 toward inlet section 12 to one which drives backplate 14 away from inlet section 12.

The force which drives backplate 14 away from the inlet section is a force which is imparted to the backplate through the cooperating threads of threaded spindle 44 and drive gear 46 and through bushing 48. The continued rotation of the motor causes drive gear 46 to bear on bushing 48 in a downstream direction which in turn drives spring loaded backplate 14 away from inlet section 12. The continued operation of the motor causes backplate 14 to move away from inlet section 12 until detent 72 of limit switch 74, which is mounted on the backplate, contacts clip 68 which is affixed to rod 18. Rod 18 is fixedly attached to inlet section 12 of valve 10.

At such time as detent 72 contacts clip 68 power to drive motor 56 is interrupted and valve 10 is in the fully closed position illustrated in FIG. 3. In the position illustrated in FIG. 3, airflow through inlet portion 12 of valve 10 is prevented by the abutment of damper plate with seating surface 34. Backplate 14 is at all times biased in the direction of seating surface 34 by springs 66 which are disposed betweeen nuts 64 and the downstream surface of backplate 14 which springs 66 abut.

Springs 66, in cooperation with the remainder of the valve assembly, comprise means for preventing motor 56 from stalling subsequent to driving damper plate 42 into sealing engagement with the cooperating seating surface 34 of inlet section 12. A tight seal between the damper plate and inlet portion seating surface is thereby achieved in a manner which is not susceptible to causing motor 56 to stall upon the closing of valve 10 to airflow.

When airflow is once again called for through valve, motor 56 is energized in a direction which causes pinion 58 and drive gear 46 to rotate in a direction that will draw threaded spindle 44 through backplate 14 in a downstream direction.

The initial reaction, however, to the driving of drive gear 46 by motor 56 in a direction so as to cause the retraction of damper plate 42 from inlet section seating surface 34 is to relieve compressed springs 66. As spindle 44 is initially drawn through drive gear 46, springs 66 react by urging backplate 14 toward inlet section 12 and into abutment with backing nuts 98 which are upstream of the damper plate on rods 18.

Therefore, before damper plate 42 is unseated by motor 56 from seating surface 34 of inlet portion 12, back plate 14 has already undergone movement in an upstream direction into abutment with backing nuts 98, motor 56 is operating and springs 66 have been relieved. Thus, prior to any retraction of damper plate 42 from contact with the inlet section seating surface, the drive motor is already in operation in a direction which causes the damper plate to be withdrawn from the inlet portion. The stalling of the motor due to the forces which act to close the valve is therefore prevented.

If maximum airflow is called for through valve 10, drive motor 56 causes the rotation of drive gear 46 in a direction which draws spindle 44, and therefore the entire damper assembly, away from the inlet section. Motor 56 will continue to run and to draw the damper assembly in the downstream direction, if the demand for conditioned air requires it, until the downstream surface of damper plate 42 comes into contact with detent 78 of limit switch 76. At such time as damper plate 42 contacts detent 78, power to motor 56 is interrupted and the damper is positioned in the fully open position. Because there are no forces acting on the damper plate when in the fully open position that correspond to the forces operating on the damper plate after it is driven into sealing abutment with the inlet section seating surface, there is no need for apparatus, other than limit switch 76, to be associated with the damper plate to prevent motor stalling when it is fully retracted from the inlet section.

If optional potentiometer 80 and gear 84, which comprise means for indicating the position of damper plate 42, are provided in valve 10, gear 84 is mounted so as to protrude through backplate 14. Gear 84 meshingly engages spiral extension 88 of drive gear 46 in a manner such that as drive gear 46 is rotated, gear 84 is cooperatively rotated in a manner which is indicative, through potentiometer 80, of the number of revolutions made by drive gear 46. The number of revolutions of drive gear 46 is indicative of the position of damper plate 42 within the air valve with respect to the fully open and fully closed positions of the damper plate. The position of damper plate 42 is thereby electromechanically monitored through potentiometer 80.

It will be appreciated that motor 56 is controlled such that damper plate 42 is precisely positioned in or between the fully open and fully closed position in accordance with the demand for conditioned air. The control of valve 10 is not the subject of the present invention.

It will also be appreciated, given the teachings herein, that many modifications might be made to the present invention which do not depart from the spirit of the invention. Therefore, the scope of the present invention is to be limited only in accordance with the language of the claims which follow.

What is claimed is:

1. An air valve comprising:

a generally cylindrical inlet section, said inlet section having a seating surface;

support means downstream of and mounted for movement with respect to said inlet section seating surface;

a damper assembly, said damper assembly being restrained from rotation and said damper assembly being supported upstream of said seating surface by said inlet section and downstream of said seating surface by said support means for movement into a position in which said assembly abuts said inlet section; and means for driving said damper assembly into abutment with said inlet section, the operation of said driving means resulting in the movement of said support means away from said inlet section subsequent to its having driven said damper assembly into abutment with said inlet section.

2. The valve according to claim 1 further comprising means for preventing said means for driving from stalling subsequent to having driven said damper assembly into abutment with said inlet section.

3. The valve according to claim 2 wherein said means for preventing comprises mans for biasing said support means toward said inlet section.

4. The valve according to claim 3 wherein said means for driving comprises an electric motor; wherein said support means includes a backplate and wherein said valve further comprises means for interrupting power to said motor subsequent to the movement of said backplate a predetermined distance away from said inlet section.

5. The valve according to claim 4 wherein said damper assembly includes a threaded portion and wherein said motor is mounted on said backplate and drivingly engages said threaded portion of said damper assembly.

6. The valve according to claim 5 wherein said means for biasing comprises spring means acting on said backplate to bias said backplate toward said inlet section.

7. The valve according to claim 6 wherein said damper assembly includes a damper plate and a threaded spindle extending downstream thereof, said motor drivingly engaging said threaded spindle portion through a drive gear mounted for rotation on said backplate, said drive gear defining a threaded aperture which is threadably penetrated by said damper assembly spindle.

8. The valve according to claim 7 wherein said damper assembly includes a portion in splined engagement with a support grid in said inlet section and wherein said motor is a reversible motor, the direction of rotation of said motor being determinitive of the direction of axial movement of said damper plate with respect to said inlet section.

9. The air valve according to claim 8 further comprising means for electromechanically indicating the position of said damper plate, said indicating means operating off of said drive gear.

10. An air valve comprising:

an inlet section defining a seating surface and having a support grid upstream of said seating surface;

support mean attached to said inlet section, said support means being located downstream of said inlet section damper means, including a damper plate, said damper means being supported downstream of said inlet section by said support means and upstream of said seating surface by said support grid, said damper plate being positionable between a first position in which it sealingly seats against said inlet section seating surface and a second position wherein said damper plate is retracted out of said inlet section;

means for preventing the rotation of said damper mans;

an electric motor, drivingly engaged with said damper means; and means for preventing the stalling of said motor subsequent to driving said damper plate into abutment with said inlet section seating surface.

11. The valve according to claim 10 further comprising means for interrupting power to said motor subsequent to the abutment of said damper plate with said inlet section seating surface.

12. The valve according to claim 11 wherein said means for preventing stalling includes means for mechanically biasing at least a portion of said support means.

13. The valve according to claim 12 wherein said support means includes a backplate moveable with respect to said inlet section.

14. The valve according to claim 13 wherein said means for mechanically biasing comprises a plurality of springs acting on said backplate so as to bias said backplate toward said inlet section, the seating of said damper plate on said inlet section seating surface and the continued operation of said motor thereafter causing said backplate to be driven away from said inlet section against said springs until said means for interrupting power operates to interrupt power to said motor.

15. The valve according to claim 14 wherein said means for preventing rotation comprises spline means on said damper means and in said support grid.

16. The valve according to claim 15 further comprising gear means and wherein said motor drives said damper means through said gear means.

17. The valve according to claim 16 wherein said gear means includes a drive gear mounted for rotation on said backplate, said drive gear defining an internally threaded aperture penetrated by a threaded spindle portion of said damper assembly, said threaded spindle portion penetrating said drive gear so that the rotation of said drive gear causes the axial movement of said damper means with respect to said inlet section.

18. The valve according to claim 17 wherein said means for interrupting power comprises a limit switch mounted on said backplate for contact with a surface which is fixed with respect to said inlet section.

19. The air valve according to claim 18 wherein said valve further comprises means for indicating the position of said damper plate with respect to said inlet section seating surface.

20. An air valve comprising:

a generally tubular unitary inlet section defining a seating surface;

a damper assembly including a damper plate, said damper plate being restrained from rotatoin and being positionable between a first position wherein said damper plate abuts said inlet section seating surface and a second position wherein said damper plate is retracted out of said inlet section, said damper assembly being supported at a first end, upstream of said seating surface, by said inlet section;

means for supporting the end of said damper assembly opposite said first end;

a reversible electric motor drivingly engaged with said damper assembly to position said damper plate; and means for preventing the stalling of said motor subsequent to the driving of said damper plate into abutment with said inlet section surface by said motor.

21. The valve according to claim 20 wherein said means for supporting includes a backplate mounted for movement with respect to said inlet section.

22. The valve according to claim 21 wherein said means for preventing stalling comprises means for mechanically biasing said backplate toward said inlet section seating surface.

23. The valve according to claim 22 further comprising means for interrupting power to said motor subsequent to the driving of said damper plate into abutment with said inlet section seating surface, the driving of said damper plate into abutment with said inlet section seating surface by said motor causing said backplate to be driven away from said inlet section against said biasing means, power to said motor being interrupted subsequent to the movement of said backplate a predetermined distance away from said inlet section.

24. The valve according to claim 23 wherein said damper assembly comprises a damper plate, a threaded downstream extending spindle and a splined upstream extending portion and wherein said inlet section defines a support grid upstream of said seating surface, said support grid having a splined portion for receiving said splined portion of said damper assembly and wherein said motor drivingly engages said threaded spindle through gear means so that the rotation of said gear means causes said damper plate to be axially positioned with respect to said inlet section seating surface, the direction of rotation of said motor being determinitive of the direction of axial movement of said damper plate.

25. An air valve comprising:

a unitary tubular inlet section defining a seating surface;

a backplate attached to and mounted for movement with respect to said inlet section;

an axially movable damper assembly, said damper assembly being supported by said inlet section upstream of said seating surface and having a generally planar damper plate that is restrained from rotation, said damper plate being driven into abutment with said inlet section seating surface to shut-off airflow through said valve;

means for biasing said backplate toward said inlet section seating surface;

an electric motor drivingly connected to said damper assembly said motor driving said backplate away from said inlet section against said biasing means immediately subsequent to driving said damper plate into abutment with said inlet section seating surface; and means for interrupting power to said motor subsequent to the driving of said backplate a predetermined distance away from said inlet section.

* * * * *